United States Patent [19]

Miki

[11] Patent Number: 4,826,393

[45] Date of Patent: May 2, 1989

[54] TURBO-MOLECULAR PUMP

[75] Inventor: Masaharu Miki, Narashino, Japan

[73] Assignee: Seiko Seiki Kabushiki Kaisha, Chiba, Japan

[21] Appl. No.: 83,692

[22] Filed: Aug. 7, 1987

[30] Foreign Application Priority Data

Aug. 7, 1986 [JP] Japan ..... 61-185497

[51] Int. Cl.[4] ..... F01D 1/36

[52] U.S. Cl. ..... 415/72; 415/90; 415/143

[58] Field of Search ..... 415/71, 72, 74, 90, 415/143

[56] References Cited

U.S. PATENT DOCUMENTS

| | | | |
|---|---|---|---|
| 2,362,922 | 11/1944 | Palm | 415/72 X |
| 3,802,794 | 4/1974 | Gehring et al. | 415/72 |
| 4,332,522 | 6/1982 | Saulgeot | 415/90 |
| 4,668,160 | 5/1987 | Mase et al. | 415/143 X |

FOREIGN PATENT DOCUMENTS

| | | | |
|---|---|---|---|
| 2412624 | 10/1974 | Fed. Rep. of Germany | 415/90 |
| 3410905 | 10/1985 | Fed. Rep. of Germany | 415/90 |
| 2446934 | 8/1980 | France . | |
| 47-33446 | 8/1972 | Japan . | |
| 60-125795 | 7/1985 | Japan | 415/90 |
| 60-182394 | 9/1985 | Japan | 415/90 |
| 61-72896 | 4/1986 | Japan | 415/90 |
| 737653 | 6/1980 | U.S.S.R. | 415/72 |

*Primary Examiner*—Robert E. Garrett
*Assistant Examiner*—Joseph M. Pitko
*Attorney, Agent, or Firm*—Bruce L. Adams; Van C. Wilks

[57] ABSTRACT

A turbo-molecular pump comprises three distinct stages corresponding to three distinct gas flow regions. The first stage comprises a plurality of stages of alternately arranged rotor blades and stator blades, and operates in a molecular flow region wherein the gas pressure is less than $10^{-3}$ torr. The second stage comprises a first helical groove formed either on the circumference of the rotor or on the circumference of the stator. The second stage is disposed downstream of the first stage and operates in a transition flow region wherein the gas pressure is from $10^{-3}$ to 1 torr. The third stage comprises second and third helical grooves formed respectively on the circumference of the rotor and stator. The third stage is disposed downstream of the second stage and operates in a viscous flow region wherein the gas pressure is greater than 1 torr. An adequate pump compression ratio can be obtained from the ultra-high vacuum region to the low vacuum region so as to significantly widen the pump operation region.

20 Claims, 3 Drawing Sheets

第2図

TURBO-MOLECULAR PUMP

BACKGROUND OF THE INVENTION

1. Field of the Invention

This invention relates to a turbo-molecular pump, especially to a turbo-molecular pump having helical grooves formed on the circumference of the rotor and stator.

2. Prior Arts

A conventional turbo-molecular pump has a plurality of blades which are disposed on circumference of the rotor and stator in plural stages in a manner that the blades of the rotor and stator are alternately arranged along a rotary axis of rotor.

But, in the exemplified case of a pump with only blades, the pump compression ratio is suddenly reduced below the more than $10^{-3}$ torr suction-port pressure region and the motor load for driving the rotor is suddenly increased.

Therefore, a pump disclosed in Japanese Patent Publication No. 33446/72 is formed of a thread-groove (helical groove) on either the rotor circumference or the stator circumference at the discharge-port side of the blades. Further, a pump disclosed in Japanese Patent Provisional Publication No. 182394/85 is formed with thread grooves on both the rotor circumference and stator circumference at discharge-port side of the blades so that thread-grooves are reversely threaded relative to each other in the threading direction.

Regretfully, the former pump disclosed in Publication No. 33446/72 has a defect that the pump compression ratio is so suddenly deterionated in the more than 1 torr region that sufficient compression ratio is not attained, as shown by the characteristic curve 100 of FIG. 2. The latter pump disclosed in Provisional Publication No. 182394/85 has a defect that a sufficient compression ratio is not obtained under the pressure region from ultra-high vacuum to 1 torr, as shown by the characteristic curve 102 of FIG. 2.

SUMMARY OF THE INVENTION

This invention has been made to alleviate the aforesaid conventional problems and one object of the invention is to provide a turbo-molecular pump in which a sufficient pump compression ratio can be obtained throughout the pressure region from the ultra-high vacuum to the low vacuum region of about 10 torr.

For attaining the foregoing object, this invention is characterized by sets of blades 10, 18 which are constituted in plural stages by alternately providing the blades on the circumferences of the rotor 16 and the stator 22 along its rotary axis, a thread-groove 12 which is formed on either the rotor circumference or the stator circumference at the downstream side from said blades 10, 18, and a couple of thread-grooves 14, 20 formed on both the rotor circumference and the stator circumference at the downstream side from said blades 10, 18 and which are reversely threaded with respect to each other. In the present invention, a thread-groove 12, which is formed on either the rotor circumference or the stator circumference, functions effectively in the less than 1 torr pressure region and a rotor thread-groove 14 and a stator thread-groove 20 function effectively in the more than 1 torr pressure region in cooperative relationship.

As shown in FIG. 2, pump operation according to the present invention is practiced in the less than about 1 torr pressure region in a manner similar to that of characteristic curve 100 and is practiced in the more than 1 torr pressure region in a manner similar to that of characteristic curve 102. Accordingly, the pump of this invention has a characteristic curve denoted by line A in FIG. 2.

DETAILED DESCRIPTION OF PREFERRED EMBODIMENT

Hereinafter, embodiments of apparatus suitable for this invention are described in conjunction with the drawings.

Figure 1:
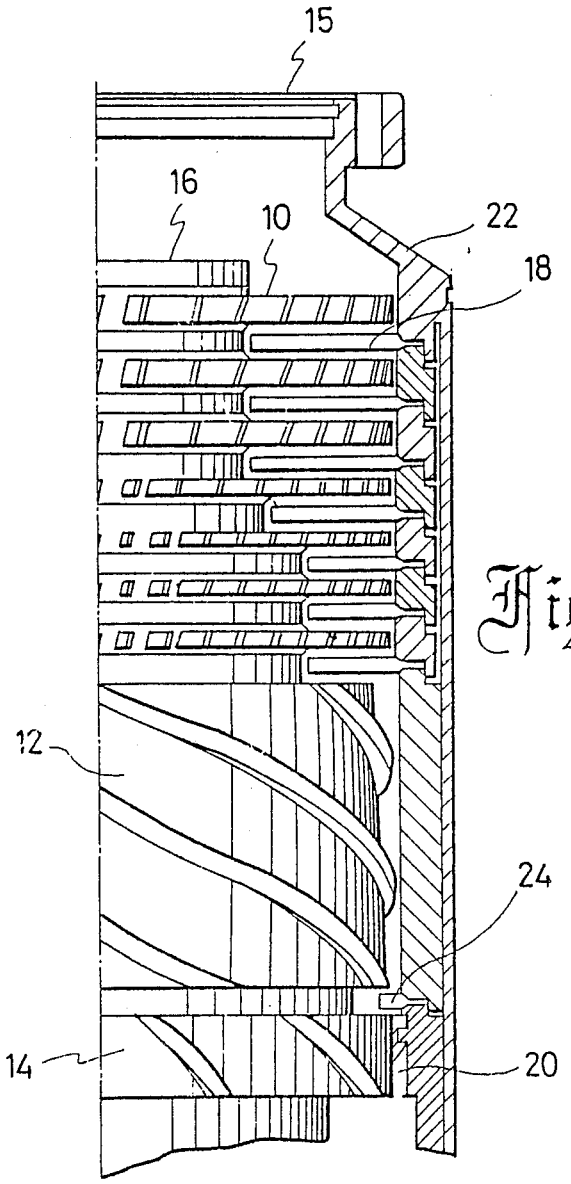
FIG. 1 is an explanatory view of an embodiment of the inner parts of am apparatus in accordance with this invention.

In FIG. 1, blades 10, which are constituted in seven stages, a first helical thread-groove or flow path and a second helical thread-groove or flow path 14 are provided on the outer circumference of a rotor 16 in a direction from a suction port 15 toward a discharge port (not shown). Further, blades 18, which are constituted in seven stages the same as the blades 10, and a helical thread-groove or flow path 20 are provided on an inner circumference of a stator 22 in the direction from the suction port 15 toward the discharge port. Each stage of rotor blade 10 and each corresponding stage of stator blade 18 are alternately arranged along the rotary axis of the rotor 16.

The helical thread-groove 20 is provided in opposed confronting relation to the rotor helical thread-groove 14 and the threading or winding directions thereof is of the two helical grooves are opposite one another. A set of blades 24 of one stage is provided upon the inner circumference of the stator 22 and is positioned at the discharge-port side of the thread-groove 12 and at the suction-port side of the thread-groove 14. The blade set 24 is provided so as to positively regulate and assist the flow of gas from the discharge port to the thread-groove 20 and the rotor thread-groove 14.

As set forth above, in this embodiment of the invention, the helical thread-groove 12 is provided upon the outer circumference of the rotor 16 and located downstream from the blades 10, 18. Upon the outer circumference of the rotor 16 and the inner circumference of the stator 22 and positioned further downstream, are disposed the reversely wound helical thread-grooves 14, 20. Accordingly, the rotor thread-groove 20 alone can function effectively in the more than 1 torr pressure region.

Figure 2:
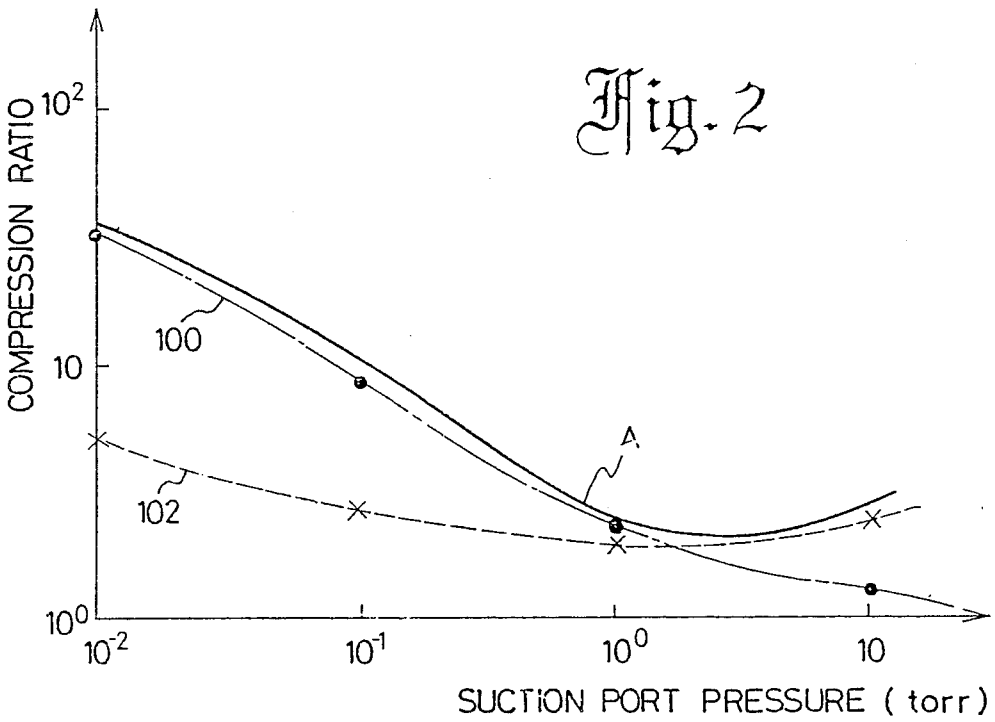
FIG. 2 is a diagram shwoing various characteristic curves of suction port pressure-compression ratios.

Consequently, in the less than about 1 torr pressure region, the pump operation is done in accordance with the characteristic curve 100 of FIG. 2 and in the more than 1 torr pressure region, it is done in accordance with the characteristic curve 102.

By this embodiment, it is enough to obtain sufficient pump compression ratio from the ultra-high vacuum region to the low vacuum region so that the pump operating region is considerably widened as shown by characteristic curve A in FIG. 2.

Also, by this embodiment, load increase of the rotor driving motor can be repressed, because enough pump compression ratio can be obtained throughout the operating range including the low pressure vacuum region.

In accordance with another aspect of the invention, the blade length of the blades 10, 18 shortens progressively in the direction toward the discharge port, as is shown in FIG. 1.

Figure 3:
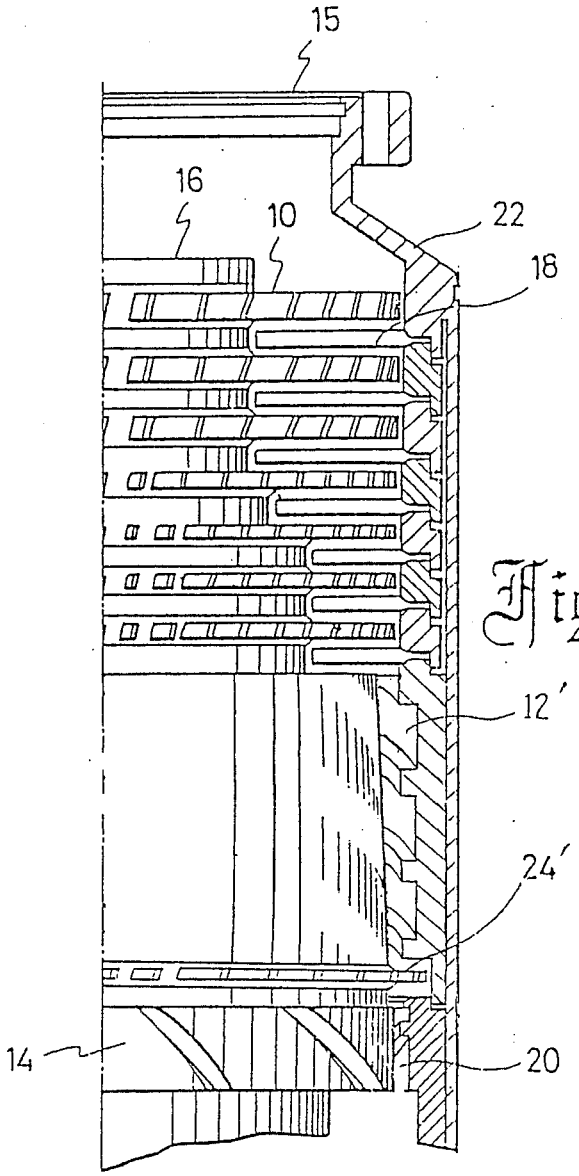
FIG. 3 is another embodiment of an apparatus in accordance with this invention.

Another embodiment according to this invention is shown in FIG. 3. In the case of this embodiment, the turbo-molecular pump in FIG. 3 has helical thread grooves 12' provided upon the inner circumference of the stator 22 and blades 24' of one stage provided around the outer circumference of the rotor 16.

As set forth above, in accordance with this invention, one side groove 12 and both side grooves 14, 20 are so arranged in series that in the less than 1 torr pressure region, the one side groove 12 functions and in the more than 1 torr pressure region, the both-side grooves 14, 20 function. Therefore, a sufficient pump compression ratio can be obtained from the ultra-high vacuum region to the low vacuum region so as to widen the effective pump operation region. Also load increase of the rotor driving motor can be repressed, because a sufficient pump compression ratio is obtained to the low vacuum region.

What is claimed is:

1. A turbo-molecular pump comprising:

a rotor;

a stator spaced from and confronting the rotor;

a plurality of stages of alternately arranged rotor blades and a stator blades respectively carried by said rotor and said stator;

a first helical groove formed on the circumference of one of the rotor and stator and disposed downstream of said rotor blades and stator blades;

a second helical groove formed on the circumference of the rotor and disposed downstream of said first helical groove; and a third helical groove formed on the circumference of the stator and disposed facing said second helical groove and being reversely threaded with respect to said second helical groove.

2. A turbo-molecular pump as claimed in claim 1; further comprising an additional stage of blades carried by said rotor and disposed between said first helical groove and said second and third helical grooves so as to regulate gas flow to said second and third helical grooves.

3. A turbo-molecular pump as claimed in claim 1; further comprising an additional stage of blades carried by said stator and disposed between said first helical groove and said second and third helical grooves so as to regulate gas flow to said second and third helical grooves.

4. A turbo-molecular pump as claimed in claim 1; wherein the lengths in a radial direction of said rotor blades and stator blades of a downstream stage thereof are less than those of an upstream stage thereof.

5. A turbo-molecular pump comprising: a stator having a suction port for admitting gas molecules; a rotor mounted to undergo rotation within the stator; means defining an upstream pump stage comprised of a plurality of stages of rotor blades carried by the rotor and a plurality of stages of stator blades carried by the stator, the respective stages of rotor blades and stator blades being disposed in the axial direction of the rotor and coacting together to pump gas molecules admitted via the suction port through the upstream stage; means defining an intermediate pump stage comprised of a set of helical flow paths on one of the rotor and stator coacting with a confronting surface portion of the other of the rotor and stator to pump gas molecules delivered from the upstream stage through the intermediate stage; and means defining a downstream pump stage comprised of confronting sets of helical flow paths on the rotor and stator, the set of helical flow paths on the rotor being helically wound in the reverse direction with respect to the set of helical flow paths on the stator and coacting therewith to pump gas molecules delivered from the intermediate stage through the downstream stage.

6. A turbo-molecular pump according to claim 5; including means interposed between the intermediate and downstream stages for positively assisting the flow of gas molecules from the intermediate stage to the downstream stage.

7. A turbo-molecular pump according to claim 6; wherein the means for positively assisting comprises another stage of blades carried by the rotor and extending radially toward the stator.

8. A turbo-molecular pump according to claim 7 wherein the intermediate stage set of helical flow paths comprises at least one helical groove on the stator.

9. A turbo-molecular pump according to claim 6; wherein the means for positively assisting comprises another stage of blades carried by stator and extending radially toward the rotor.

10. A turbo-molecular pump according to claim 9; wherein the intermediate stage set of helical flow paths comprises at least one helical groove on the rotor.

11. A turbo-molecular pump according to claim 5; wherein the intermediate stage set of helical flow paths comprises at least one helical groove on the rotor.

12. A turbo-molecular pump according to claim 5; wherein the intermediate stage set of helical flow paths comprises at least one helical groove on the stator.

13. A turbo-molecular pump according to claim 5; including means defining an annular space between the intermediate and downstream stages.

14. A turbo-molecular pump according to claim 13; including means extending into the annular space for positively assisting the flow of gas molecules from the intermediate stage to the downstream stage.

15. A turbo-molecular pump according to claim 5; wherein the rotor blades extend radially toward the stator and the stator blades extend radially toward the rotor, the lengths of the rotor and stator blades in the radial direction of a downstream stage thereof being less than those of an upstream stage thereof.

16. A turbo-molecular pump according to claim 13; including means interposed between the intermediate and downstream stages for positively assisting the flow of gas molecules from the intermediate stage to the downstream stage.

17. A turbo-molecular pump according to claim 16; wherein the means for positively assisting comprises another stage of blades carried by the rotor and extending radially toward the stator.

18. A turbo-molecular pump according to claim 17; wherein the intermediate stage set of helical flow paths comprises at least one helical groove on the stator.

19. A turbo-molecular pump according to claim 16; wherein the means for positively assisting comprises another stage of blades carried by stator and extending radially toward the rotor.

20. A turbo-molecular pump according to claim 19; wherein the intermediate stage set of helical flow paths comprises at least one helical groove on the rotor.

* * * * *